US005189408A

United States Patent [19]

Teicher

[11] Patent Number: 5,189,408

[45] Date of Patent: Feb. 23, 1993

[54] ORIENTATION-SENSITIVE DISPLAY SYSTEM

[76] Inventor: Mordechai Teicher, 9 Gordon Street, 44 260 Kfar Saba, Israel

[21] Appl. No.: 814,159

[22] Filed: Dec. 30, 1991

[30] Foreign Application Priority Data

Jan. 21, 1991 [IL] Israel ..... 96983

[51] Int. Cl.[5] ..... G08B 5/00

[52] U.S. Cl. ..... 340/815.01; 200/61.52; 340/686; 340/691; 368/225; 374/142

[58] Field of Search ..... 340/815.01, 789, 752, 340/700, 691, 686, 693, 689; 368/225, 22; 200/56 R, 61.52, 61.45 R; 374/142, 170, 210; 40/450

[56] References Cited

U.S. PATENT DOCUMENTS 3,161,738 12/1964 Hall ..... 200/61.52
3,955,356 5/1976 Le Cocq ..... 368/225
4,158,173 6/1979 Saraceni ..... 200/61.52
4,836,075 6/1989 Armstrong ..... 200/61.52
4,906,971 3/1990 Schmid et al. ..... 340/691
4,965,553 10/1990 DelBiondo, II et al. ..... 340/686

*Primary Examiner*—Glen R. Swann, III
*Attorney, Agent, or Firm*—Benjamin J. Barish

[57] ABSTRACT

An orientation-sensitive display system, includes a portable housing including a visual display; at least one source of information, such as time and/or temperature, to be displayed; a gravity-sensitive device for sensing the relative position of the housing; and a data processor receiving information from the source of information, and controlled by the gravity-sensitive device, for controlling the visual display in accordance with the orientation of the housing as sensed by the gravity-sensitive device.

20 Claims, 2 Drawing Sheets

ORIENTATION-SENSITIVE DISPLAY SYSTEM

FIELD AND BACKGROUND OF THE INVENTION

The present invention relates to a data processor and display system, and particularly to a display system which is sensitive to orientation. The invention is especially applicable for displaying time and/or temperature, and is therefore described below with respect to such an application, but it will be appreciated that the invention could be used for displaying other types of information.

The present highly advanced state of the digital processor technology has enabled many types of digital display devices, such as clocks, thermometers, etc., to be developed in the form of small compact units containing their own data processors and power supplies. Most of these display devices are based on a 7-segment LCD (liquid crystal display) or LED (light emitting diode) displays, in which each digit is constituted of 7 segments which are selectively energized by a driver circuit in order to indicate the respective digit. Many of these display devices are single-purpose devices, including their own sources of information, such as a real-time watch or clock for displaying time or a thermometer for displaying temperature. However, many are multi-purpose display devices including two or more sources of information each of which may be selected for display.

OBJECTS AND BRIEF SUMMARY OF THE INVENTION

An object of the present invention is to provide a novel data display system which is capable of changing its display automatically by merely reorienting the housing of the visual display.

According to one aspect of the present invention, there is provided an orientation-sensitive display system, comprising: a housing including a visual display and orientable with the visual display to either an upright position or to an inverted position; at least one source of data to be displayed; a gravity-sensitive device for sensing the relative position of the housing; and data processor means receiving data from the source, and controlled by the gravity-sensitive device, for controlling the visual display of the data in accordance with the orientation of the housing as sensed by the gravity-sensitive device such that when the housing is in the upright position, the visual display of the data is in an upright orientation with respect to the housing, and when the housing is in the inverted position, the visual display of the data is in an inverted orientation with respect to the housing, whereby the visual display of the data appears in the same orientation to a viewer in both positions of the housing.

According to another aspect of the present invention, there is provided an orientation-sensitive display system, comprising: a housing including a visual display; at least one source of information to be displayed; a gravity-sensitive switch for sensing the relative position of the housing and being actuated to a first condition when the housing is in its normal upright position, and to a second condition when the housing is in an inverted position; and data processor means receiving information from the source of information, and controlled by the gravity-sensitive device, for controlling the visual display in accordance with he orientation of the housing as sensed by the gravity-sensitive device.

In the described preferred embodiments, the gravity-sensitive device is a switch which is actuated to a first condition when the housing is in its normal position, and to a second condition when the housing is in an inverted position. The gravity-sensitive switch may be any one of many known types, e.g., a mercury switch or a ball switch.

In some described embodiments, the source of information is or includes a real-time clock.

In one described embodiment, the data processor means controls the visual display to cause it to display the same time oriented in the same direction when the housing is either in its normal position or in its inverted position. Such an embodiment may be useful, for example, in a wrist watch wherein the watch casing (housing) is held in one (upright) position when facing the wearer for reading the time, and in another (inverted) position when facing another person to enable such other person to read the time.

Another embodiment of the invention is described below wherein the data processor means controls the visual display to cause it to display the same time but on the basis of a 12-hour system in one position of the housing, and on the basis Of a 24-hour system in the other position of the housing. A still further embodiment is described wherein the data processor controls the visual display to cause it to display the time in one time zone in the normal position of the housing, and the time in a second time zone in the inverted position of the housing.

Still further embodiments are described wherein the source of information is or includes a thermometer for measuring ambient temperature. In one described embodiment, the data processor means controls the visual display to cause it to display the temperature in degrees Centigrade in one position of the housing, and in degrees Fahrenheit in the other position of the housing; and in a further described embodiment, the data processor means controls the visual display to cause it to display the time in one position of the housing, and the temperature in the other position of the housing.

In most described embodiments, the housing is a portable housing having a pair of opposed supporting surfaces enabling the housing to be stably supported on a flat horizontal surface in either its normal position or inverted position however, when the invention is embodied in a watch, e.g., a wrist-watch, this housing would be the watch casing worn on the wrist of the user. The preferred visual display is one that includes a plurality of characters each defined by seven segments, although it will be appreciated that other forms of visual displays, such as dot matrix, preformed character or CRT-tube displays, may also be used.

Further features and advantages of the invention will be apparent from the description below.

BRIEF DESCRIPTION OF THE DRAWINGS

The invention is herein described, by way of example only, with reference to the accompanying drawings, wherein.

DESCRIPTION OF PREFERRED EMBODIMENTS

Figure 1:
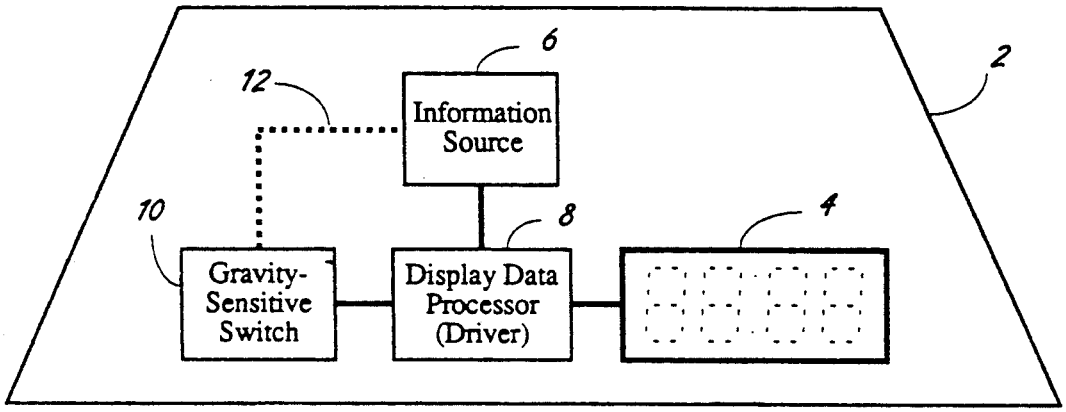
FIG. 1 is a block diagram illustrating the essential components of one form of orientation-sensitive display system constructed in accordance with the present invention.

FIG. 1 is a block diagram illustrating the essential components of one form of data display system constructed in accordance with the present invention. Thus, the system includes a housing, generally designated 2, which includes a visual display 4, preferably of the above-described 7-segment type. Housing 2 further includes an information source 6, such as a clock for measuring real-time, and/or a thermometer for measuring ambient temperature. The information from source 6 is fed to a display data processor 8, commonly called a driver, which processes this data in accordance therewith, controls the energization of the segments of display 4.

Housing 2 further includes a gravity-sensitive switch 10,, e.g., of the mercury or ball type, which senses the relative orientation of the housing. The gravity-sensitive switch 10 is actuated to a first condition when the housing is in its normal position, and to a second condition when the housing is in an inverted position. Data processor 8 receives the information from source 6, and is controlled by gravity-sensitive switch 10 so as to control the visual display in accordance with the relative position of the housing as sensed by the gravity-sensitive switch.

Information source 6 may be a source of any type of information (e.g. time) but manifested in two different ways (e.g., a 12-hour and a 24-hour time system, or two different time zones); or it may be a source of two (or more) different types of information (e.g., time and temperature). In some cases, particularly where source 6 has two different types of information, the source 6 would also be controlled by the gravity-sensitive switch, as shown schematically by the broken line 12 in FIG. 1, to select the type of information to be displayed according to the orientation of the housing.

Figure 2A:
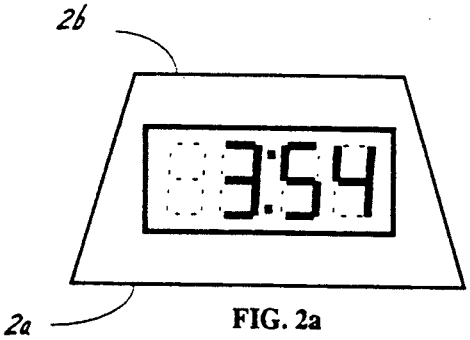
FIGS. 2*a* and 2*b* illustrate the display produced in the normal and inverted positions of the housing according to one embodiment of the invention.
Figure 2B:
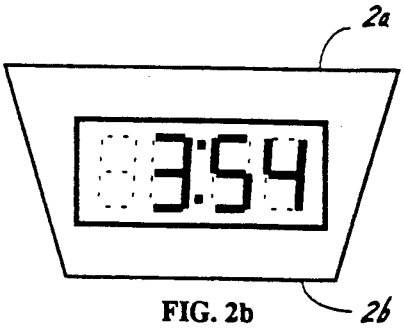

FIGS. 2*a* and 2*b* illustrate one embodiment of the invention, wherein the housing 2 is formed with a first supporting surface 2*a* for stably supporting the housing in its normal position on a flat horizontal surface, and a second supporting surface 2*b* for stably supporting the housing on the same horizontal surface but in an inverted position. In this example, the information source 6 is a real-time clock. Thus, when housing 2 is supported in its normal position on surface 2*a*, as illustrated in FIG. 2*a*, data processor 8 controls display 4, to display the time in its normal upright form; and when the housing 2 is moved to its inverted position as illustrated in FIG. 2*b*, this is sensed by the gravity-sensitive switch 10 which controls data processor 8 so as to cause the display 4 to display the same time in its normal upright form, rather than in its inverted form.

Housing 2 may be a wrist watch, such that the user may hold his hand one way to position the housing in an upright position in order to view time display 4 in its normal upright condition; but when the user turns the wrist watch upside down, e.g., to show the time to another viewer, the inversion of the wrist watch will be sensed by gravity-sensitive switch 10. Switch 10 will control the data processor 8 to cause the display 4 to energize the segments of the display in such manner to enable the other viewer also to see the time in an upright position, rather than in an inverted position.

Figure 3A:
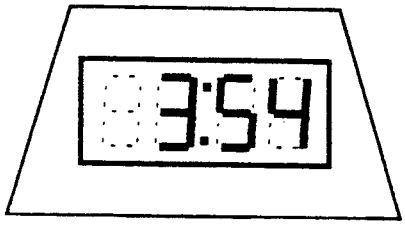
FIGS. 3*a*, 3*b*, 4*a*, 4*b*, 5*a*, 5*b*, illustrate the displays produced in the normal and inverted positions of the housing, respectively, according to other embodiments of the invention.
Figure 3B:
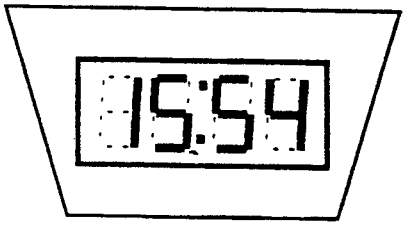

FIGS. 3*a* and 3*b* illustrate another embodiment of the invention, wherein the information source 6 also is or includes a real-time clock. In this case, however, the data processor 8 controls the visual display 4 to cause it to display the same time but on the basis of a 12-hour system in one (e.g., upright) position of the housing 2 as shown in FIG. 3*a*, and on the basis of a 24-hour system in the other (e.g., inverted) position of the housing as shown in FIG. 3*b*.

It will be appreciated that instead of displaying the time according to a 12-hour system and a 24-hour system, respectively, the data processor may control the display to display the time in one time zone in one (e.g., normal) position of the housing, and the time in a second (selected) time zone in the other (inverted) position of the housing. The time difference would of course have to be present in this system.

Figure 4A:
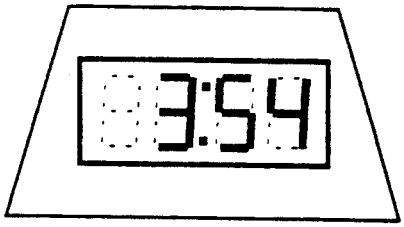
Figure 4B:
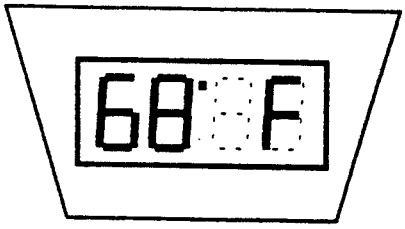

FIGS. 4*a* and 4*b* illustrate a further embodiment of the invention, wherein the information source 6 includes both a clock for measuring real-time, and a thermometer for measuring ambient temperature. In this variation, the data processor 8 controls the display 4 to cause it to display the time in one position of the housing as illustrated in FIG. 4*a*, and the temperature in the second position of the housing.

Figure 5A:
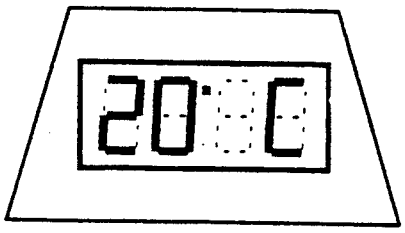
Figure 5B:
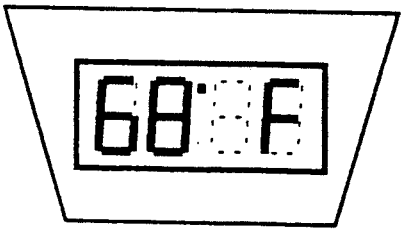

FIGS. 5*a* and 5*b* illustrate a further embodiment of the invention, wherein the information source 6 is or includes a thermometer for measuring ambient temperature. In this case, the data processor 8 controls the display 4 so as to display the temperature in degrees Centigrade in one position of the housing, and in degrees Fahrenheit in the other position of the housing.

In all the described embodiments, the change in display produced by the data processor in response to the position of the housing, as sensed by the gravity-sensitive switch 12, may be controlled by a look-up table stored within the data processor, or computed by a computer.

While the invention has been described with respect to several preferred embodiments, it will be appreciated that other variations may be made. For example, the housing could be of a polygonal configuration enabling it to be oriented in more than two positions (e.g., 3, 4, 6, etc.), with a gravity-sensitive device being effective to select one type or form of information to be displayed according to the orientation of the housing. Many other variations, modifications and applications of the invention will be apparent.

What is claimed is:

1. An orientation-sensitive display system, comprising:

a housing including a visual display and orientable with the visual display to either an upright position or to an inverted position;

at least one source of data to be displayed;

a gravity-sensitive device for sensing the relative position of the housing;

and data processor means receiving data from said source, and controlled by said gravity-sensitive device, for controlling the visual display of the data in accordance with the orientation of the housing as sensed by said gravity-sensitive device such that when the housing is in the upright position, the visual display of the data is in an upright orientation with respect to the housing, and when the housing is in the inverted position, the visual display of the data is in an inverted orientation with respect to the housing, whereby the visual display of the data appears in the same orientation to a viewer in both positions of the housing.

2. The system according to claim 1, wherein said gravity-sensitive device is a switch which is actuated to a first condition when the housing is in its normal position, and to a second condition when the housing is in an inverted position.

3. The system according to claim 1, wherein said source of information includes a thermometer for measuring ambient temperature.

4. The system according to claim 3, wherein said data processor means controls the visual display to cause it to display the temperature in degrees Centigrade in one position of the housing, and in degrees Fahrenheit in the other position of the housing.

5. The system according to claim 3, wherein said source of information includes both a clock and a thermometer, and said data processor means controls the visual display to cause it to display the time in one position of the housing, and the temperature in the other position of the housing.

6. The system according to claim 1, wherein said housing is a portable housing having a pair of opposed supporting surfaces enabling the housing to be stably supported on a flat horizontal surface in either said normal position or inverted position.

7. The system according to claim 1, wherein said visual display includes a plurality of characters each defined by seven segments.

8. An orientation-sensitive display system, comprising:

a portable housing including a visual display and a plurality of supporting means enabling the housing to be stably supported on a flat horizontal surface in any one of a plurality of selected orientations with respect to the flat supporting surface;

at least one source of information to be displayed;

a gravity-sensitive device for sensing the relative orientation of the housing;

and data processor means receiving information from said source of information, and controlled by said gravity-sensitive device, for controlling the visual display in accordance with the orientation of the housing as sensed by said gravity-sensitive device.

9. The system according to claim 8, wherein said gravity-sensitive device is a switch which is actuated to a first condition when the housing is in a normal position, and to a second condition when the housing is in an inverted position.

10. The system according to claim 9, wherein said source of information includes a real-time clock.

11. The system according to claim 10, wherein said data processor means controls said visual display to cause it to display the same time oriented in the same direction when the housing is either in its normal position or in its inverted position.

12. The system according to claim 10, wherein said data processor means controls said visual display to cause it to display the same time but on the basis of a 12-hour system in one position of the housing, and on the basis of a 24-hour system in the other position of the housing.

13. The system according to claim 10, wherein said data processor means controls said visual display to cause it to display the time in one time zone in the normal position of the housing, and the time in a second time zone in the inverted position of the housing.

14. The system according to claim 8, wherein said source of information includes a thermometer for measuring ambient temperature.

15. The system according to claim 14, wherein said data processor means controls the visual display to cause it to display the temperature in degrees Centigrade in one position of the housing, and in degrees Fahrenheit in the other position of the housing.

16. The system according to claim 8, wherein said source of information includes both a clock and a thermometer, and said data processor means controls the visual display to cause it to display the time in one position of the housing, and the temperature in the other position of the housing.

17. An orientation-sensitive display system, comprising:

a housing including a visual display;

at least one source of information to be displayed;

a gravity-sensitive switch for sensing the relative position of the housing and being actuated to a first condition when the housing is in its normal upright position, and to a second condition when the housing is in an inverted position;

and data processor means receiving information from said source of information, and controlled by said gravity-sensitive device, for controlling the visual display in accordance with the orientation of the housing a sensed by said gravity-sensitive device.

18. The system according to claim 17, wherein said source of information includes a real-time clock, and wherein said data processor means controls said visual display to cause it to display the same time oriented in the same direction when the housing is either in its normal position or in its inverted position.

19. The system according to claim 17, wherein said data processor means controls said visual display to cause it to display the same time but on the basis of a 12-hour system in one position of the housing, and on the basis of a 24-hour system in the other position of the housing.

20. The system according to claim 17, wherein said data processor means controls said visual display to cause it to display the time in one time zone in the normal position of the housing, and the time in a second time zone in the inverted position of the housing.

* * * * *